US008459086B2

(12) United States Patent
Vigurs

(10) Patent No.: US 8,459,086 B2
(45) Date of Patent: Jun. 11, 2013

(54) PROCESS FOR PRODUCING A DIE

(75) Inventor: Stanley Walter Vigurs, West Midlands (GB)

(73) Assignee: UEI Fine Cut Limited (GB)

( * ) Notice: Subject to any disclaimer, the term of this patent is extended or adjusted under 35 U.S.C. 154(b) by 879 days.

(21) Appl. No.: 12/517,955

(22) PCT Filed: Dec. 4, 2007

(86) PCT No.: PCT/GB2007/004637

§ 371 (c)(1),
(2), (4) Date: Jun. 5, 2009

(87) PCT Pub. No.: WO2008/068473

PCT Pub. Date: Jun. 12, 2008

(65) Prior Publication Data

US 2010/0319433 A1 Dec. 23, 2010

(30) Foreign Application Priority Data

Dec. 7, 2006 (GB) ..... 0624463.6
Apr. 3, 2007 (GB) ..... 0706403.3

(51) Int. Cl.
*B21D 3/00* (2006.01)
*B21C 37/06* (2006.01)

(52) U.S. Cl.
USPC ..... 72/367.1; 72/363; 72/368; 72/462; 101/28

(58) Field of Classification Search
USPC ..... 72/48, 51, 367.1, 368, 462, 363; 492/30, 492/37; 430/300, 307, 310, 323; 101/3.1, 101/22, 23, 382.1, 383, 389.1, 28, 32
See application file for complete search history.

(56) References Cited

U.S. PATENT DOCUMENTS 2,213,568 A * 9/1940 Rohland ..... 101/401.2
3,490,369 A * 1/1970 Huck ..... 101/378
3,610,143 A * 10/1971 Greenwood et al. ..... 430/308
3,863,550 A * 2/1975 Sarka et al. ..... 493/468
3,882,775 A * 5/1975 Lytle et al. ..... 101/415.1
4,029,013 A * 6/1977 George et al. ..... 101/389.1
4,106,408 A 8/1978 Holland (Continued)

FOREIGN PATENT DOCUMENTS

EP 0 172 947 A1 3/1986
EP 0 400 621 A2 12/1990

(Continued)

OTHER PUBLICATIONS

Search report from the corresponding patent application in Great Britain GB 2 444 627 A, Apr. 2008.

(Continued)

*Primary Examiner* — Edward Tolan
(74) *Attorney, Agent, or Firm* — Hovey Williams LLP

(57) ABSTRACT

A method of making an impression die comprises the steps of providing a substantially planar bendable bimetal plate 10 consisting of copper and steel bonded together, forming a relief pattern 14 in the surface of the copper for example by an etching process, forming the plate into a non-planar sleeve with the copper on the outside and joining the free edges of the sleeve together. Preferably the free edges of the sleeve 10 are joined together while the sleeve is mounted on a metal mandrel 15.

18 Claims, 3 Drawing Sheets

U.S. PATENT DOCUMENTS

| | | | | |
|---|---|---|---|---|
| 4,116,594 | A * | 9/1978 | Leanna et al. | 425/3 |
| 4,195,557 | A * | 4/1980 | Kang | 493/324 |
| 4,684,429 | A | 8/1987 | Dalton, Jr. | |
| 4,923,572 | A * | 5/1990 | Watkins et al. | 205/69 |
| 5,281,511 | A | 1/1994 | Gerhardt | |
| 5,521,030 | A * | 5/1996 | McGrew | 430/1 |
| 6,017,657 | A * | 1/2000 | Mentz et al. | 430/1 |
| 6,258,311 | B1 * | 7/2001 | Jens et al. | 264/220 |
| 6,716,017 | B2 * | 4/2004 | Papadopoulas | 425/194 |
| 6,925,934 | B2 * | 8/2005 | Weschenfelder et al. | 101/351.6 |

FOREIGN PATENT DOCUMENTS

| | | | |
|---|---|---|---|
| EP | 0526867 | B1 | 8/1992 |
| EP | 1 212 202 | B1 | 6/2006 |
| GB | 1486473 | | 9/1977 |
| GB | 2 444 627 | A | 6/2008 |

OTHER PUBLICATIONS

International Search Report for PCT/GB2007/004637, Apr. 2008.
UK Intellectual Property Office Examination Report of application No. GB0723665.6, Jun. 2010.
Response by E. Fenwick submitted to the UK Intellectual Property Office for application No. GB0723665.6, Dec. 2010.
Confirmation withdrawal of application / appeal dated Dec. 5, 2012, in European Patent No. 1212202, Issued: Aug. 16, 2006, Applicant: Universal Engraving, Inc.
Letter relating to Appeal Procedure dated Mar. 27, 2012, in European Patent No. 1212202, Issued: Aug. 16, 2006, Applicant: Universal Engraving, Inc.
Statement of grounds of appeal dated Nov. 3, 2011, in European Patent No. 1212202, Issued: Aug. 16, 2006, Applicant: Universal Engraving, Inc.
Statement of grounds of appeal dated Sep. 28, 2011, in European Patent No. 1212202, Issued: Aug. 16, 2006, Applicant: Universal Engraving, Inc.
Decision of the Opposition Division and instruction dated May 18, 2011, in European Patent No. 1212202, Issued: Aug. 16, 2006, Applicant: Universal Engraving, Inc.
Grounds for the decision (Annex)—opposition dated May 18, 2011, in European Patent No. 1212202, Issued: Aug. 16, 2006, Applicant: Universal Engraving, Inc.
Letter regarding the opposition procedure (no time limit) dated Mar. 11, 2011, in European Patent No. 1212202, Issued: Aug. 16, 2006, Applicant: Universal Engraving, Inc.
Annex to the communication—opposition dated Nov. 18, 2010, in European Patent No. 1212202, Issued: Aug. 16, 2006, Applicant: Universal Engraving, Inc.
Scanned annex to a communication—opposition procedure dated Nov. 18, 2010.
Reply of the patent proprietor to the notice(s) of opposition dated Oct. 22, 2007, in European Patent No. 1212202, Issued: Aug. 16, 2006, Applicant: Universal Engraving, Inc.
Notice of Opposition dated Aug. 30, 2006, in European Patent No. 1212202, Issued: Aug. 16, 2006, Applicant: Universal Engraving, Inc.

* cited by examiner

PROCESS FOR PRODUCING A DIE

BACKGROUND

This invention relates to a new process for producing a non-planar bimetal die, particularly in roll form usually in the form of a cylinder. EP 0526 867B1 describes a process for making a cylindrical die suitable for embossing a relief on a material. In this process a photoresist layer is applied to one side of a planar steel sheet, the photoresist layer is exposed through a template provided with a pattern corresponding to the required relief, the coating is then developed so that unexposed regions of the photoresist layer are removed, the steel sheet is then bent into the shape of a cylindrical sleeve with the remaining regions of the photoresist layer on the outside and the photoresist layer is then exposed to etching liquid until it is etched to the required depth. The facing free edges of the sleeve are then connected together to form an etched cylindrical die for use on a mandrel of the same diameter. Typically, the resulting die is made so that it is nearly as long as the mandrel upon which it is to be mounted and it is connected to the mandrel at least at one end by complementary formations e.g. a peg and slot. Whilst this process produces steel dies which are successfully used in the trade, there is a need for dies having higher definition in the pattern image, and a greater depth of relief, particularly where the resulting pattern includes e.g. very fine lines or a particularly intricate pattern.

According to one aspect of the present invention a method of making an impression die comprises the steps of providing a substantially planar bendable bimetal plate consisting of a non-ferrous metal and steel bonded together, forming a relief pattern in the surface of the non-ferrous metal, forming the plate into a non-planar sleeve with the non-ferrous metal on the outside and joining the free edges of the sleeve together. According to a further aspect of the present invention a method of making an impression die comprises the steps of providing a substantially planar bendable bimetal plate consisting of a non-ferrous metal and steel bonded together, forming a relief pattern in the surface of the non-ferrous metal, forming the plate into a non-planar sleeve with the non-ferrous metal on the outside and joining the free edges of the sleeve together whilst the sleeve is mounted on a metal mandrel.

According to yet another aspect of the present invention a method of making an impression die comprises the steps of providing a substantially planar bendable bimetal plate consisting of a non-ferrous metal and steel bonded together, forming a relief pattern in the surface of the non-ferrous metal, forming the plate into a non-planar sleeve with the non-ferrous metal on the outside and joining the free edges of the sleeve together whilst the sleeve is mounted on a metal mandrel characterised in that when the metal mandrel is heated it expands so that the sleeve fits closely upon it. The dimensions of the tooling mandrel (i.e. the mandrel on which the impression die is formed) and the operating mandrel (i.e. the mandrel on which the resulting impression die (sleeve) is mounted for use), are preferably chosen such that 1. The tooling mandrel is slightly larger than the operating mandrel so that a die made to fit the tooling mandrel will also fit the operating mandrel and
2. The impression die (sleeve) has a close ('interference') fit on the operating mandrel when heat is applied.

The resulting impression die (sleeve) is preferably cylindrical as the machinery currently used in the industry requires cylindrical dies to fit on cylindrical mandrels. As already stated, the resulting impression die is preferably made to a size that will be a close fit around the operating mandrel. The operating mandrel is preferably made of such material (i.e. aluminium) that when heated it expands more than the impression die. Therefore, when the mandrel is heated during the subsequent embossing, hot foiling or hot sealing process it has been found that the die fits tightly around the mandrel. This is advantageous as it minimises the risk of the sleeve moving in relation to the mandrel in such a process and also stretches the sleeve around the mandrel such that the inside surface of the sleeve complies precisely with the outside diameter of the mandrel. This ensures a high degree of compliance between the outer surface of the sleeve and the rotational axis of the mandrel required for high quality hot foiling. Preferably the sleeve is located on its operating mandrel by means of at least one mechanical locating means e.g. at least one low profile screw through one or more punched holes in the die and one or more tapped holes in the underlying mandrel or by way of at least one dowel pin (locating peg) screwed into the operating mandrel which then locate into one or more punched slots in the etched sleeve. The number of, and position of, locating means when used may be varied according to whether the sleeve extends entirely across the width of the mandrel or only partially across. Alternatively, it may be possible just to slide the sleeve onto a mandrel with the sleeve being sized to be such a tight fit on the mandrel that there would be no need for a locating means to hold the sleeve on the mandrel.

There is no need to provide magnets, as has already been proposed in other processes as a means of attachment of cylindrical sleeves around mandrels, and thus it is not essential for the steel to be magnetic.

Using this process it is possible for a die to be made which has a much higher definition in the pattern image and/or a greater depth of relief. Further, the die may not have to be as long as the operating mandrel upon which it is to be mounted, thus reducing cost because less material is required. Also, because a shorter length die can be used, means that less copper has to be etched or mechanically engraved away. This may reduce the cost of production by increasing the time before the etching solution is 'exhausted' and has to be replaced or, in the case of mechanical engraving, the time taken to engrave the pattern may be reduced.

The non-ferrous metal is preferably copper where the relief pattern is formed by an etching process. Alternatively the non-ferrous metal may be an alloy preferably brass where the relief pattern is formed by an engraving process. The description refers to the preferred copper/steel plate but is not limited thereto. Preferably the copper/steel plate is made by cladding the two metals together with no intervening layer of adhesive or other component. These bimetal sheets are readily available commercially e.g. as 'CuFe Bi-Metal Sheet' from Engineered Materials Solutions, USA. The overall thickness of the bimetal plate is preferably between 0.5 and 1.5 mm, with the proportions being from 0.2 mm to 0.4 mm steel (preferably the thickness of the steel is substantially i.e. approximately 0.2 mm), with the remainder of the thickness being made up of copper. The cladding process usually used is the well known process where a layer of copper is bought into surface engagement with a layer of steel and the two layers are fed between one or more compression rollers. The rollers apply extremely high pressures on opposite sides of the copper and steel layers, thus resulting in a strongly bonded bimetal plate.

Preferably the leading and trailing edges of the plate have the copper layer removed for a width of about 5 mm and are then joined together (steel to steel) by the process already well known as spot-welding, which is a form of resistance welding. In the process a welding tool (an electrode through which a current is passed) is pressed against the top face of a lapped joint of the steel layer of the laminated material and a high current passed through. The poor conductivity across the join of the lapped joint creates heat which forms a local melt and fuses the two steel layers together. There is usually no need to weld the entire seam, only a series of points along the lapped area—hence the term 'spot' welding. This joining process is preferred to the use of adhesive because that would be more time-consuming, costly and less reliable. Other welding techniques can also be used e.g. laser welding, in which case the edges to be joined may be butt-welded rather than overlapped.

The relief pattern in the surface of the copper is preferably produced by a etching process but may be produced by a mechanical engraving process. Where an etching process is used, it is preferably that process known in the art as 'deep etching'. The deep etching process consists of exposing the surface of the copper side of the laminate which has been coated with an etch resist in appropriate areas, to a solution of ferric chloride that has a special additive added. The effect of the additive is to form a soft coat on the copper surface that is resistant to the ferric chloride. By spraying the ferric/additive solution at an appropriate pressure and temperature, it is possible to blast away the coating on flat surfaces so etching takes place, but not on any surface that does not face the direction of the sprayed ferric directly, thus leaving the etch resistant coat on the sides of any detail. This prevents 'undercutting' and allows the etch to continue to depths around 1 mm without weakening the preserved image.

It will be appreciated that certain features of the invention, which are, for clarity, described in the context of separate embodiments, may also be provided in combination in a single embodiment. Conversely, various features of the invention, which are for brevity described in the context of a single embodiment, may also be provided separately or in any suitable combination.

BRIEF DESCRIPTION OF DRAWINGS

Embodiments of the present invention will now be described with reference to the accompanying drawings in which:

Referring to FIG. 1, a deep etched copper on steel bimetal sleeve 10, made by the process according to the present invention on a tooling mandrel (not shown), fits tightly onto an operating mandrel 15 (not visible here, but shown in FIG. 2) and is positioned by means of a removable locating (dowel) peg 11 through corresponding locating slot 12. The locating slot 12 can be provided anywhere around the sleeve. Heating the mandrel causes it to expand more than the sleeve which thus fits closely to it. The sleeve overlaps and, using a strip of land from which all traces of copper have been removed (leaving only the steel backing material), is joined to itself by means of spot welds 13 at 5 mm intervals. Etched images 14 (0.7 mm deep) have been formed by the deep etch process into the surface of the copper (0.8 mm thick). The assembly is thus ready to be used e.g. in an embossing process.

FIG. 2 shows the sleeve 10 mounted on the heated aluminium operating mandrel 15. One of the spot welded lap joints 13 can be seen. The steel backing 16 (0.2 mm thick) can also be seen. Etched images 14 (0.7 mm deep) have been formed by the deep etch process into the surface of the copper (0.8 mm thick).

FIG. 3 shows the heated operating mandrel 15 (upon which sleeve 10 would be mounted) provided with locating holes 17 spaced at 10 mm intervals to accept a removable locating peg 11.

Figure 1:
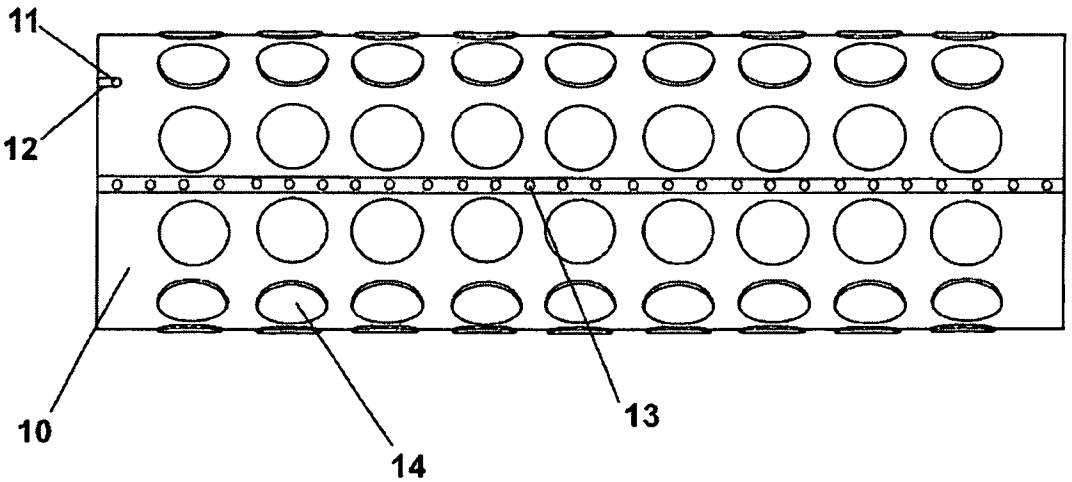
FIG. 1 is a side view showing a spot welded die sleeve registered with a locating peg on an operating mandrel.
Figure 2:
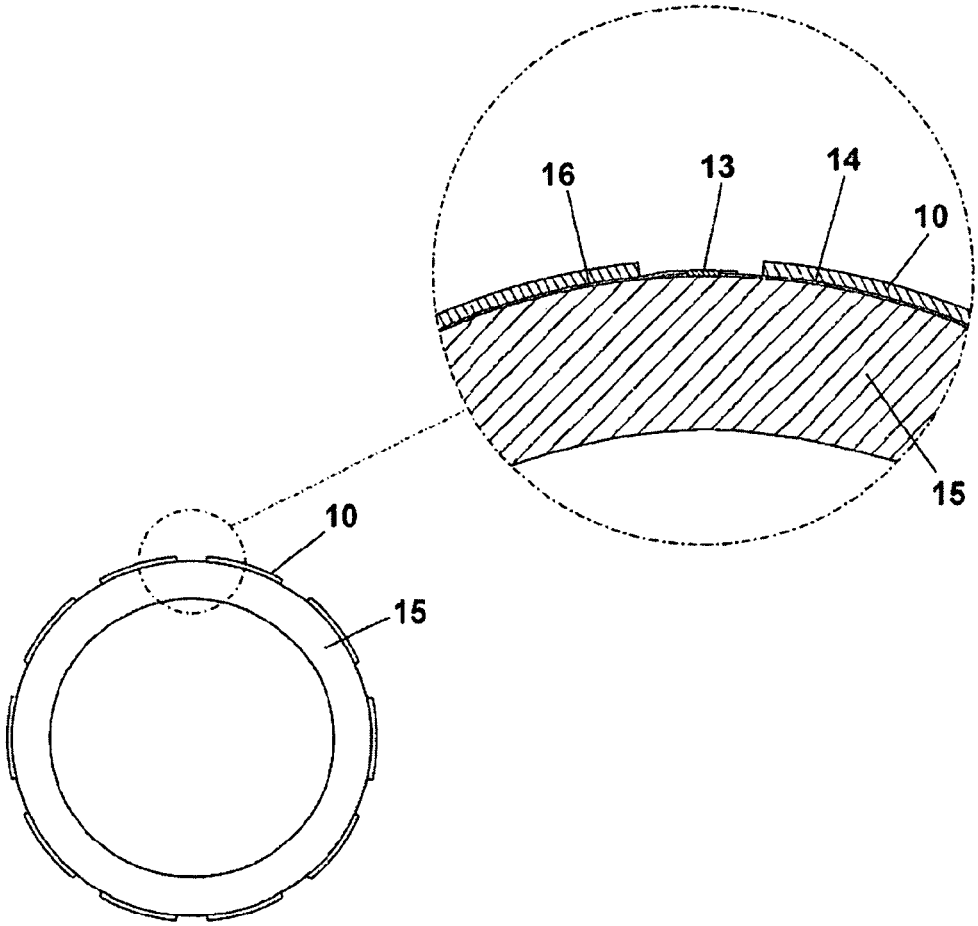
FIG. 2 is a full view and a partial view from one end showing the detail of the spot welded lapped joint. The full view shows the die sleeve in position on the operating mandrel.
Figure 3:
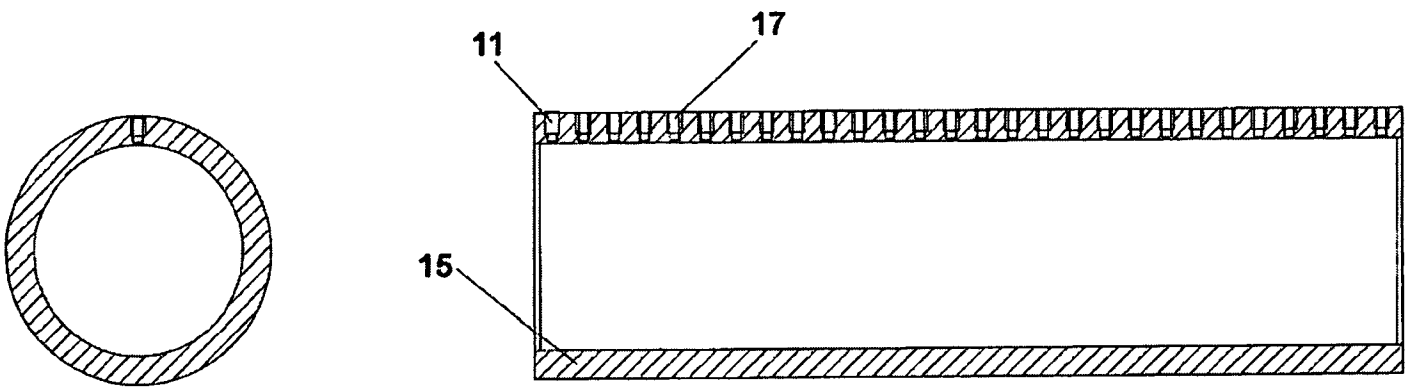
FIG. 3 is a longitudinal section through the centre line of the (aluminium) operating mandrel upon which the die sleeve (not shown) will be mounted. The series of tapped holes to take one or more locating pegs in varying positions can be clearly seen. Also shown is an 'end-on' view.

The invention claimed is:

1. A method of making an impression die for use in an embossing, hot foiling, or hot stamping process, the method comprising the steps of:

providing a single substantially planar bendable bimetal plate having a non-ferrous metal layer and a steel layer bonded together, wherein said bimetal plate includes leading and trailing edges;

forming a relief pattern in the surface of the non-ferrous metal layer by an etching process;

removing substantially all of the non-ferrous metal layer along at least a portion of each of the leading and trailing edges of the plate to expose the steel layer at said leading and trailing edges to secure the edges together;

forming the plate into a single non-planar sleeve with the non-ferrous metal layer on the outside; and securing the leading and trailing edges of the plate together along at least a portion of the exposed steel layer so as to form a single continuous sleeve.

2. A method according to claim 1, wherein the sleeve is generally cylindrical.

3. A method according to claim 1, wherein there is no intervening layer between the non-ferrous metal and steel layers.

4. A method according to claim 3, wherein the non-ferrous metal and steel layers are bonded together via cladding.

5. A method according to claim 1, wherein the thickness of the plate is in the range 0.5 to 1.5 mm.

6. A method according to claim 1, wherein the thickness of the steel layer is from 0.2 mm to 0.4 mm.

7. A method according to claim 1, wherein the thickness of the steel layer is substantially 0.2 mm.

8. A method according to claim 1, wherein the leading and trailing edges of the plate are joined together by welding.

9. A method according to claim 8, wherein the leading and trailing edges of the plate are joined together by spot welding.

10. A method according to claim 1, wherein the relief pattern in the surface of the non-ferrous metal layer is produced by a deep etching process.

11. A method according to claim 1, wherein the non-ferrous metal layer comprises copper.

12. A method according to claim 1, wherein the leading and trailing edges of the sleeve are secured together while the sleeve is mounted on a metal mandrel.

13. A method according to claim 12, wherein the sleeve extends substantially entirely across the width of the mandrel.

14. A method according to claim 12, wherein the sleeve extends only partially across the width of the mandrel.

15. A method according to claim 12, wherein when the metal mandrel is heated, it expands so that the sleeve fits closely upon it.

16. A method according to claim 1, wherein the leading and trailing edges of the plate are overlapped prior to being secured together.

17. A method according to claim 1, wherein the leading and trailing edges of the plate are secured together via butt-welding.

18. A method according to claim 1, wherein the non-ferrous metal layer is removed for a width of about 5 mm along the leading and trailing edges of the plate to expose the steel layer.

* * * * *